United States Patent [19]

Garcez et al.

[11] 4,338,129

[45] Jul. 6, 1982

[54] PRODUCTION OF VERMICULAR GRAPHITE CAST IRON

[75] Inventors: João D. Garcez, Sao Paulo, Brazil; Michael D. Bryant, Bromsgrove, England

[73] Assignee: Foseco International Limited, Birmingham, England

[21] Appl. No.: 213,490

[22] Filed: Dec. 5, 1980

[30] Foreign Application Priority Data

Dec. 19, 1979 [GB] United Kingdom ..... 7943697

[51] Int. Cl.[3] ..... C22C 33/08

[52] U.S. Cl. ..... 75/130 R; 75/53

[58] Field of Search ..... 75/53, 130 R

[56] References Cited

U.S. PATENT DOCUMENTS

| | | | |
|---|---|---|---|
| 3,945,819 | 3/1976 | Easwaran | 75/58 |
| 3,953,198 | 4/1976 | Easwaran | 75/58 |
| 3,984,233 | 10/1976 | Easwaran | 75/58 |

*Primary Examiner*—P. D. Rosenberg

*Attorney, Agent, or Firm*—Cushman, Darby & Cushman

[57] ABSTRACT

A treatment agent for use in the production of vermicular graphite cast iron is formed by compacting a mixture comprising particulate iron, magnesium, titanium and rare earth.

14 Claims, No Drawings

PRODUCTION OF VERMICULAR GRAPHITE CAST IRON

This invention relates to the production of vermicular graphite cast iron.

The term vermicular graphite cast iron is used to denote cast iron in which flake graphite has been modified to a rounded, shorter form compared with the graphite in normal grey cast iron. This modified form of graphite is also known by other names, including "quasi-flake" and "compacted".

Vermicular graphite cast iron is usually produced by treating molten iron with magnesium in conjunction with titanium and one or more rare earth metals. Usually the magnesium is added as a 5% magnesium ferrosilicon containing cerium and titanium is added as ferrotitanium or titanium metal. Cerium and other rare earth metal may also be added as mischmetall.

The quantity of titanium required in relation to the quantity of magnesium added is dependent on the section thickness of the particular casting being produced, and the requirements for producing thin section castings such as exhaust manifolds will therefore differ from those for producing thick section castings such as ingot moulds. However in general if the quantity of magnesium ranges from 0.015% to 0.035%, at the low end the titanium required will be of the order of 0.08–0.10% while at the high end the titanium required will be in excess of 0.15%.

It can be difficult to produce the correct graphite structure when making separate additions of the magnesium, titanium and rare earth metal, and an iron containing excessive titanium or an iron which has a modular graphite structure due to the presence of insufficient titanium for the quantity of magnesium present can easily result.

These difficulties can be overcome by using special alloys containing magnesium, titanium and rare earth metals, and British Pat. No. 1 427 445 describes the production and use of such alloys.

We have now found that vermicular graphite cast iron can be produced effectively and reliably without the necessity to produce a special treatment alloy using a compact containing iron powder, magnesium, titanium and a rare earth metal.

According to the present invention there is provided a molten metal treatment agent formed by compacting a mixture comprising particulate iron, magnesium, titanium and rare earth.

According to a further feature of the invention there is provided a method for the production of vermicular graphite cast iron which comprises treating molten iron with a compacted treatment agent formed from particulate iron, magnesium, titanium and rare earth.

Various types of iron powder may be used, for example sponge iron, iron powder or steel powder. When sponge iron is used its purity should preferably be at least 98% since impurities (mainly iron oxide and alumina) tend to react with the magnesium. Preferably the iron powder has a particle size of less than 0.5 mm.

The magnesium may be present as pure magnesium or in the form of a high magnesium content alloy. The preferred particle size of the magnesium is less than 2.0 mm, more preferably less than 0.7 mm.

The titanium may be present as titanium metal or as an alloy such as ferrotitanium. Preferably the titanium is of similar particle size to the magnesium.

The rear earth metal may be added in metallic form, for example as mischmetall, in the form of a rare earth salt such as a fluoride or in the form of an alloy such as a silicide.

The treatment agents of the invention may conveniently be in the form of briquettes, tablets or pellets, which may be produced by known methods involving compacting a mixture of the components at high pressures. The agents may be produced on a conventional vertical or horizontal tabletting press, a preferred method is to compact the composition between contrarotating rolls.

Carbon, for example crystalline graphite, may be added to the mixture to improve compactability and aid in achieving the desired density. The addition of carbon also helps breakdown of the treatment agent in molten iron by preventing the particles of iron powder from sintering together.

To avoid segregation of the components during mixing and to aid in bonding of the treatment agent it may be desirable to add a binder to the mixture such as a gum or a natural or synthetic resin.

In order to control the reactivity of the magnesium it is desirable to include a proportion of calcium in the composition as described in U.S. Pat. No. 4,173,466. The calcium is preferably added in the form of calcium silicide.

Preferably the treatment agents of the invention have a density in excess of 4.3 g/cm$^3$, in order that when such agents are used to treat molten iron by an "overpour" technique, they remain in the molten metal sufficiently long to effect the desired treatment and do not float to the surface too fast.

Preferably the treatment agent has the following composition by weight:

| | |
|---|---|
| Magnesium | 1.0–10.0% |
| Titanium | 1.0–20.0% |
| Rare earth | 0.05–4.0% |
| Calcium | 0.1–10.0% |
| Iron | balance |

As discussed previously the quantity of titanium required in relation to the quantity of magnesium present in order to produce a vermicular graphite structure depends on the section thickness of the casting being produced. The actual composition of the treatment agent may therefore vary quite widely within the above limits. Since the treatment agents of the invention are simple to produce, compared with the known special alloys, it is convenient to produce a range of treatment agents having different chemical compositions to suit different types of castings.

The weight of briquettes or tablets of treatment agent used to treat molten iron will depend on the composition of the iron but will usually be in the range 0.5–3.0% by weight based on the weight of the iron.

After treatment with the briquettes or tablets it is usual to inoculate the iron, e.g. with ferrosilicon.

The following example will serve to illustrate the invention:

A composition for use in the production of compacted graphite cast iron was prepared by mixing together the following components in the following proportions by weight:

| | |
|---|---|
| Sponge iron | 68.0% |

-continued

| | |
|---|---|
| Magnesium | 5.0% |
| Titanium | 9.5% |
| Rare earth fluoride | 0.5% |
| Calcium silicide | 17.0% |

2% by weight of a phenol-formaldehyde resin based on the weight of the composition was added during mixing.

The composition was formed into briquettes by means of a contra-rotating roll briquetting machine operating at a pressure of 5 tonne/cm$^2$.

Molten iron of carbon content 3.5% and silicon content 2.0% was treated with 1.5% by weight of the briquettes based on the weight of the iron, by pouring the iron over the briquettes at the bottom of a ladle. The iron was inoculated with 0.5% by weight ferrosilicon based on the weight of the iron and cast into 2.5 cm diameter test bars.

On examination the cast iron was found to have a fully vermicular graphite structure.

We claim:

1. A molten metal treatment agent formed by compacting a mixture comprising particulate iron, magnesium, titanium and rare earth.

2. A treatment agent according to claim 1 wherein the particulate iron is sponge iron powder, iron powder or steel powder.

3. A treatment agent according to claim 1 wherein the particulate iron has a particle size of less than 0.5 mm.

4. A treatment agent according to claim 1 wherein the magnesium is present as pure magnesium or as a magnesium alloy.

5. A treatment agent according to claim 1 wherein the titanium is present as titanium metal or ferrotitanium.

6. A treatment agent according to claim 1 wherein the particulate magnesium and titanium have a particle size of less than 2.0 mm.

7. A treatment agent according to claim 1 wherein the rare earth is present as metal, as a salt or as an alloy.

8. A treatment agent according to claim 1 wherein the rare earth is cerium.

9. A treatment agent according to claim 1 and including a proportion of carbon.

10. A treatment agent according to claim 1 and including a proportion of calcium.

11. A treatment agent according to claim 1 and containing by weight:

| | |
|---|---|
| 1.0–10.0% | magnesium |
| 1.0–20.0% | titanium |
| 0.05–4.0% | rare earth |
| 0.1–10.0% | calcium |

and balance iron.

12. A treatment agent according to claim 1 and having a density greater than 4.3 g/cm$^3$.

13. A method for the production of vermicular graphite cast iron which comprises treating molten iron with a compacted treatment agent formed from particulate iron, magnesium, titanium and rare earth.

14. A method according to claim 13 in which the quantity of treatment agent used is in the range of 0.5–3.0% by weight based on the weight of the iron.

* * * * *